United States Patent [19]

Poyer

[11] Patent Number: 4,523,263

[45] Date of Patent: Jun. 11, 1985

[54] OUTDOOR LIGHTING FIXTURE

[76] Inventor: David D. Poyer, 858 Roseway St., Naples, Fla. 33942

[21] Appl. No.: 623,319

[22] Filed: Jun. 22, 1984

[51] Int. Cl.[3] ..... F21V 29/00

[52] U.S. Cl. ..... 362/267; 362/306; 362/390; 362/310; 362/431; 362/368; 362/374

[58] Field of Search ..... 362/145, 152, 267, 362, 362/365, 368, 374, 375, 390, 431, 306, 310

[56] References Cited

U.S. PATENT DOCUMENTS 3,840,735 10/1974 Chan ..... 362/267
4,128,865 12/1978 Johnson ..... 362/374 X
4,143,413 3/1979 Kelly ..... 362/431 X
4,394,716 7/1983 Campagna et al. ..... 362/267 X
4,414,616 11/1983 de Vos et al. ..... 362/145 X

*Primary Examiner*—Peter A. Nelson

[57] ABSTRACT

A low voltage lighting fixture designed for outdoor use and constructed mainly of polyvinyl chloride. The fixture includes a cylindrical housing made entirely of white high density polyvinyl chloride, a 12 volt lamp, a lens, a pair of rubber O-rings, a lens, a lens retaining ring made of polyvinyl chloride, a circular rear base plate, and a power line passing through a hole in the base plate for energizing said lamp. The lamp is sealed within the housing by the two O-rings, the lens and the retaining ring.

6 Claims, 3 Drawing Figures

OUTDOOR LIGHTING FIXTURE

BACKGROUND AND SUMMARY OF THE INVENTION

My invention relates to an electric lighting fixture and in particular to a low voltage lighting fixture designed for outdoor use and constructed mainly of polyvinyl chloride resin.

In the past, for various reasons, most electric lighting fixture housings and fittings have been made of metal. One reason is that metals do not deteriorate or deform as the result of the high temperatures generated within a lighting fixture by the standard 110 volt lamps used in conventional lighting fixtures. However, for lighting fixtures designed for use out-of-doors, most metal housings and fittings are subject to rapid corrosion due to constant exposure to rain and sun and, in coastal areas, to salt spray, even when the metal parts are temporarily protected by paint. Moreover, recent increases in the price of steel and aluminum and in fabricating costs have resulted in increases in the prices of conventional lighting fixtures with housings and fittings made of metal.

The present trend to reduce energy consumption has resulted in increased use of low voltage lamps, that is, electric lamps which operate at voltages considerably less than 110 volts. These low voltage lamps, particularly 12 volt lamps, generate far less heat in operation than 110 volt lamps.

I have determined that it is possible to construct a very satisfactory outdoor lighting fixture for use with a low voltage lamp which has a housing and essentially all its components made of polyvinyl chloride resin. Such a lighting fixture is less expensive to manufacture and more durable than conventional outdoor fixtures.

Simply put, my unique lighting fixture comprises eight major components as follows: a cylindrical housing having at its center an interior annular ring preferably made entirely of white high density polyvinyl chloride resin (hereinafter often referred to as PVC); a low voltage electric lamp having an outer diameter slightly less than the inside diameter of the cylindrical housing; a lens having an outer diameter slightly less than the inside diameter of the housing; a pair of flexible O-rings for sealing the lamp and lens within the housing; an annular lens retaining ring preferably made of white PVC; a tubular conduit containing the electric wires connected to entergize the lamp; and a circular base plate preferably made of PVC for sealing the rear of the housing. The fixture may also include one or more spacer rings made of PVC for increasing the spacing between the lamp and the lens and/or the interior ring of the housing.

As assembled, an O-ring or preferably a spacer ring and then an O-ring are seated on the upper edge of the interior ring of the cylindrical housing and then the preferably 12 volt electric lamp is seated on the first O-ring. Next a second O-ring is seated on the upper outer surface of the lamp and then the lens is placed on top of the second O-ring. Then the annular lens retaining ring is firmly pressed onto the upper face of the lens and secured to the upper edge of the housing by stainless steel screws or other suitable means. The electric wires connected to energize the lamp are contained within a tubular conduit which enters the fixture through a hole in the center of the circular base plate that seals the rear of the housing.

Various modifications or additions can be made to the basic fixture just described. A light diffuser can be substituted for the lens retaining ring. A mounting bracket or swiveled stand can be added to the rear of the housing.

I am aware of a number of prior suggestions in the art to use various plastic and elastomeric resins in the fabrication of lighting fixture components. These suggestions include U.S. Pat. Nos. 3,902,057; 4,210,841; 4,360,862, 4,379,321; 4,380,793 and 4,414,613. However, my outdoor lighting fixture possesses the following advantages over conventional outdoor fixtures as well as over the devices shown in the foregoing patents:

1. Because most of its components are already available in quantity, the cost of its components is lower than the cost of conventional fixture components.

2. Because its eight components can be quickly assembled by unskilled labor, my lighting fixture costs less to manufacture than conventional fixtures.

3. Because it utilizes a low voltage lamp and its housing is contructed of white high density polyvinyl chloride resin, the housing will not deteriorate or deform in operation.

4. Because its housing and most of the fittings are made of white high density polyvinyl chloride resin, the fixture is literally impervious to the deleterious effects of sun, rain and salt spray even in tropical climates.

DETAILED DESCRIPTION OF THE PREFERRED EMBODIMENT

Figure 1:
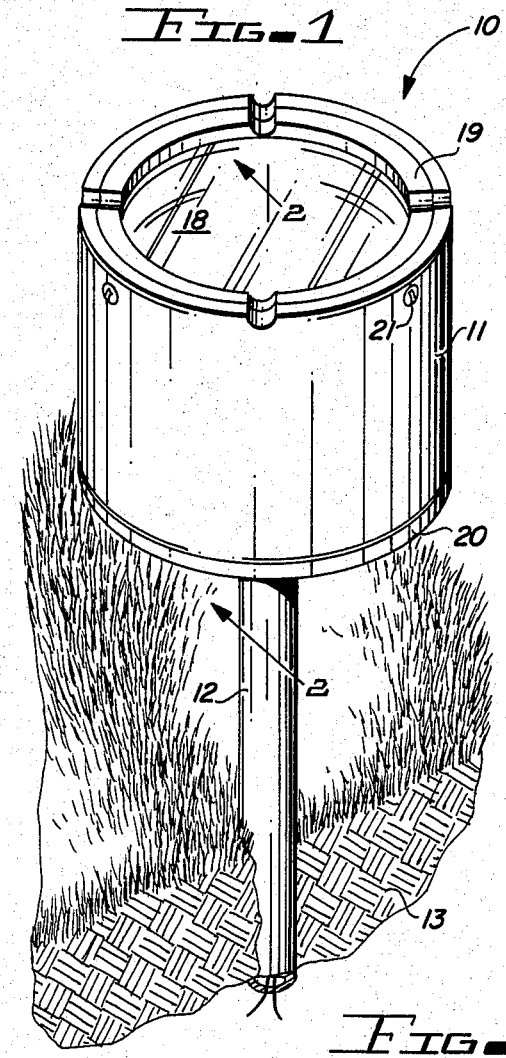
FIG. 1 is a perspective view of a preferred embodiment of my outdoor lighting fixture installed on a lawn with its lens pointing upwardly.

Referring to the drawings which illustrate a preferred embodiment of my lighting fixture but which are not intended to limit the scope of the invention, FIG. 1 is a perspective view of my outdoor lighting fixture 10 with its cylindrical housing 11 in a vertical position supported by tubular conduit 12. The lower portion of conduit 12 is buried in a lawn 13. Conduit 12 contains the electric power line whose wire ends are connected to the electric lamp within housing 11.

Figure 3:
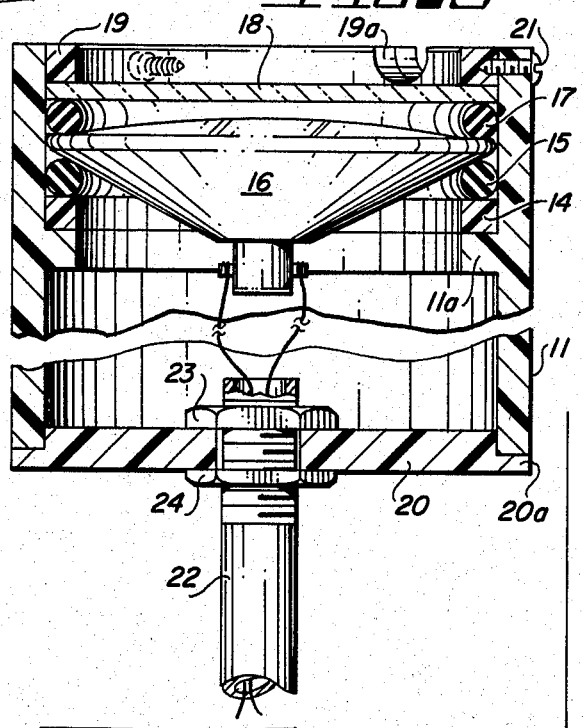
FIG. 3 is an exploded perspective view of the lighting fixture shown in FIG. 1 which shows more clearly the details of the various components of the fixture and the manner of their assembly.
Figure 2:
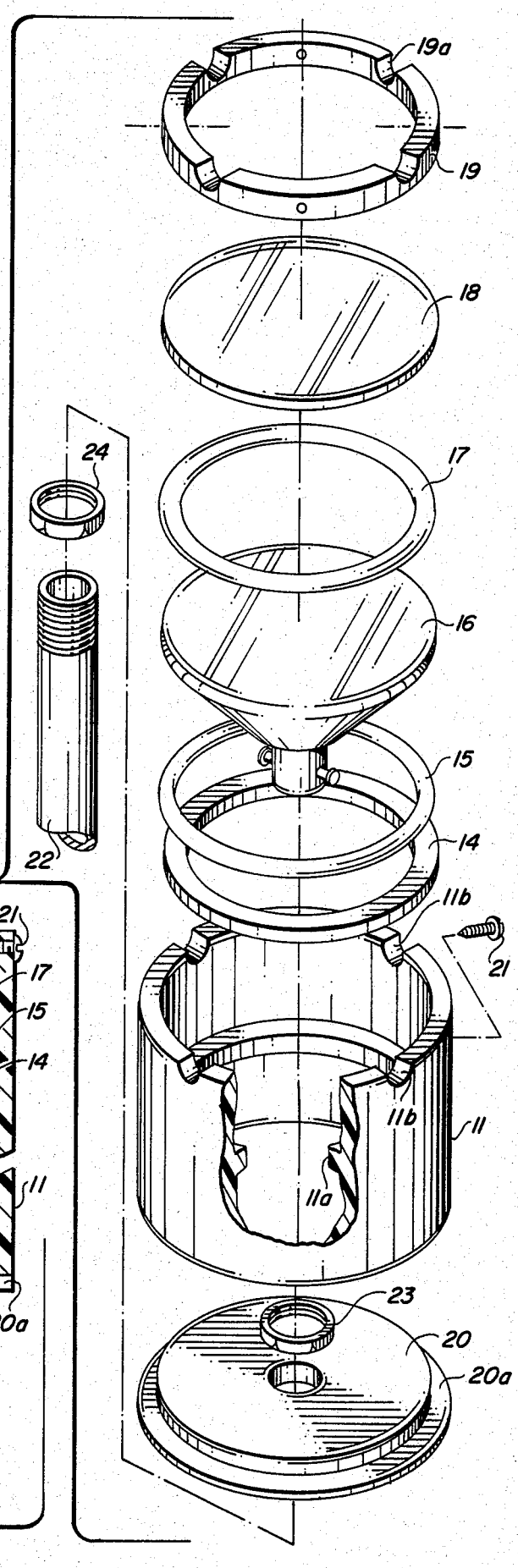
FIG. 2 is a cross-sectional view of my lighting fixture shown in FIG. 1 taken along line 2—2.

FIGS. 2 and 3 show in detail the major components of my lighting fixture. Housing 11 is a standard 5-inch outside diameter coupling used for joining electrical plastic conduit (EPC) with an annular ring **11*a* molded into the interior surface of housing 11 as best shown in FIG. 3. Ring 11*a*** is preferably square in cross-section. Most couplings used to join electrical plastic conduit are made of the same white high density polyvinyl chloride resin as the conduit itself. Preferably the housing of my fixture is manufactured to meet National Electrical Manufacturers Association standards designation EPC-40-PVC or EPC-80-PVC.

A spacer ring 14 preferably square in cross-section sits on the upper edge of ring **11*a* and an O-ring 15 of rubber or other compressible water resistant material sits on the upper edge of spacer ring 14. Electric lamp 16 sits on the upper surface of O-ring 15**.

Electric lamp 16 is preferably a General Electric Company model H 7514 lamp which operates at 18 watts off a 12 volt alternating current power line. However, other low voltage lamps operating on either direct or alternating current may be used. Lamp 16 has an outer diameter of 4⅜ths inches and an overall height of 2½ inches with two screw type terminals in its base for connection to the wire ends of the power line as shown in FIG. 2.

Another O-ring 17 similar to O-ring 15 is positioned above lamp 16 and then lens 18 is positioned within housing 11 on top of O-ring 17. Lens 18 as shown is flat and made of a clear plastic or glass. However, the lens may be curved and/or tinted in a variety of colors. In any event, the outer diameter of lens 18 should be just slightly less than the inner diameter of housing 11.

To securely fix the position of lamp 16 and lens 18 within housing 11, a retaining ring 19 is pressed down upon lens 18 and maintained in position by a plurality of stainless steel screws 21 screwed into the outer edge of ring 19 through holes drilled radially through housing 11 as shown in the drawings. Housing 11 and retaining ring 19 preferably contain a plurality of aligned semicircular grooves **11*b* and 19*a* respectively, which grooves act as drainage points for water which otherwise may tend to collect upon the upper surface of lens 18**. However, the pair of O-rings act to seal the fixture against the entry of moisture which might impair the proper operation of the lamp.

The rear end of the fixture is sealed by a flanged circular base plate 20 made of PVC as are housing 11, spacer ring 14 and retaining ring 19. Plate 20 includes a flange **20*a* sized to fit plate 20 onto the rear end of housing 11** and these two components are securely bonded together by a suitable water-impervious adhesive.

Base plate 20 contains a circular hole in its center through which passes a tubular conduit 22 containing the power line which energizes lamp 16. Conduit 22 may be made of either metal or a suitable plastic such as PVC or polyethylene. The end of conduit 22 is preferably threaded and secured to the base plate of fixture 10 by inner and outer nuts 23 and 24 as shown in FIGS. 2 and 3.

While low voltage lamp 16 is thus quite securely sealed within the fixture, the housing, rings and base plate being made of white high density polyvinyl chloride will not deteriorate or deform even under constant, round the clock operation of the lamp. And also these PVC components will not deteriorate or deform as the result of constant year round exposure to rain, tropical sun and salt spray. It is important, however, that the components be made of white PVC since that color offers greater resistance to the collection of heat from the sun's rays or the operation of the lamp itself.

It will be apparent to those skilled in the art that various modifications of the lighting fixture may be made to increase the use of the fixture. For example, a cylindrical or conical light diffuser may be added to the front of the fixture or used to replace retaining ring 19. And a fixed or swivelled stand or mounting bracket could be attached at the rear of housing 11 and other means than conduit 22 used to bring the power line into the interior of fixture 10. These and other modifications may be made without sacrificing the many advantages of my basic fixture as described above and as set forth in the following claims.

I claim:

1. An electric lighting fixture for outdoor use comprising:

a cylindrical housing made entirely of polyvinyl chloride and having concentric inner and outer walls, said housing having an annular ring projecting from its inner wall, a first flexible O-ring having an outer diameter slightly less than the diameter of the inner wall of said housing positioned against the surface of said ring, a low voltage electric lamp having an outer diameter slightly less than the diameter of the inner wall of said housing, the lower edge of said lamp being positioned against said first O-ring, a second O-ring identical to the first O-ring positioned against the upper edge of said lamp, a circular lens having an outer diameter slightly less than the diameter of the inner wall of said housing positioned against said second O-ring, and a lens retaining ring made entirely of polyvinyl chloride with an outer diameter slightly less than the diameter of the inner wall of said housing firmly pressed against the outer surface of said lens so as to cause the two flexible O-rings to seal against the inner wall of said housing and said ring being secured in position by joinder to said housing.

2. An electric lighting fixture as set forth in claim 1 in which the cylindrical housing and the lens retaining ring are both made of white high density polyvinyl chloride resin.

3. An electric lighting fixture as set forth in claim 1 in which a spacer ring made of polyvinyl chloride and having an outside diameter slightly less than the diameter of the inner wall of said housing is positioned between the annular ring of the housing and the first O-ring.

4. An electric lighting fixture as set forth in claim 1 including a circular base plate made of polyvinyl chloride closing the rear end of the cylindrical housing.

5. An electric lighting fixture as set forth in claim 4 in which the base plate contains a hole through which passes a tubular conduit carrying the electric power line which entergizes the lamp of the fixture.

6. An electric lighting fixture comprising:

a cylindrical housing made entirely of white polyvinyl chloride resin having concentric inner and outer walls and an annular ring projecting from its inner wall, a first O-ring made of water resistant compressible material and having an outer diameter slightly less than the diameter of the inner wall of said housing positioned against said annular ring, a low voltage lamp having upper and lower edges and an outer diameter slightly less than the diameter of the inner wall of said housing, the lower edge of said lamp positioned against said first O-ring, a second O-ring identical to the first O-ring positioned against the upper edge of said lamp, a circular lens having an outer diameter slightly less than the diameter of the inner wall of said housing positioned against said second O-ring, and a lens retaining ring made entirely of white polyvinyl chloride resin having an outer diameter slightly less than the diameter of the inner wall of said housing pressed firmly against the outer surface of said lens so as to cause the two O-rings to compress and seal against the inner wall of said housing, said ring being secured in position by joinder to said housing.

* * * * *